US005561504A

United States Patent [19]

Watanabe et al.

[11] Patent Number: 5,561,504

[45] Date of Patent: Oct. 1, 1996

[54] PROCESS CARTRIDGE, METHOD FOR ASSEMBLING SAME AND IMAGE FORMING SYSTEM WITH SELF-REGULATING LIQUID SEAL FEATURE

[75] Inventors: Kazushi Watanabe, Yokohama; Tadayuki Tsuda; Isao Ikemoto, both of Kawasaki, all of Japan

[73] Assignee: Canon Kabushiki Kaisha, Tokyo, Japan

[21] Appl. No.: 314,441

[22] Filed: Sep. 28, 1994

Related U.S. Application Data

[63] Continuation of Ser. No. 894,517, Jun. 4, 1992, abandoned.

[30] Foreign Application Priority Data

| | | | |
|---|---|---|---|
| Jun. 5, 1991 | [JP] | Japan | 3-159952 |
| Jun. 5, 1991 | [JP] | Japan | 3-159953 |
| May 15, 1992 | [JP] | Japan | 4-123607 |

[51] Int. Cl.[6] ..... G03G 15/00

[52] U.S. Cl. ..... 355/215; 355/211; 355/245; 355/296; 156/304.5

[58] Field of Search ..... 355/215, 245, 355/211, 260, 200, 296; 264/DIG. 48, 129; 427/420, 284, 385.5; 156/292, 295, 304.5

[56] References Cited

U.S. PATENT DOCUMENTS

| | | | |
|---|---|---|---|
| 2,442,936 | 6/1948 | Rohdin | 156/292 X |
| 3,985,436 | 10/1976 | Tanaka et al. | 355/200 |
| 4,137,341 | 1/1979 | Adachi | 427/284 X |
| 4,262,036 | 4/1981 | Mineyama et al. | 427/284 X |
| 4,392,958 | 7/1983 | Ganzi et al. | 264/DIG. 48 X |
| 5,051,778 | 9/1991 | Watanabe et al. | 355/200 |
| 5,208,634 | 5/1993 | Ikemoto et al. | 355/215 |

FOREIGN PATENT DOCUMENTS

| | | | |
|---|---|---|---|
| 6708964 | 2/1968 | Netherlands | 427/420 |

*Primary Examiner*—Arthur T. Grimley
*Assistant Examiner*—Shuk Y. Lee
*Attorney, Agent, or Firm*—Fitzpatrick, Cella, Harper & Scinto

[57] ABSTRACT

A process cartridge removably mountable in an image forming system, includes an image bearing member, process means acting on the image bearing member, a first member which forms a part of a developer container for containing developer, a second member which forms a part of the developer container for containing the developer, a seal member obtained by solidifying liquid material as an elastomer and disposed on connection surfaces at which the first and second members are joined to each other, and a regulating means provided in the connection surface of the first member to be joined to the second member and adapted to regulate the movement of the liquid material. An image forming system to which such a process cartridge can be removably mounted, and a method for assembling such a process cartridge, also are provided.

64 Claims, 12 Drawing Sheets

PROCESS CARTRIDGE, METHOD FOR ASSEMBLING SAME AND IMAGE FORMING SYSTEM WITH SELF-REGULATING LIQUID SEAL FEATURE

This application is a continuation of application Ser. No. 07/894,517, filed Jun. 4, 1992, now abandoned.

BACKGROUND OF THE INVENTION

1. Field of the Invention

The present invention relates to a process cartridge, a method for assembling such a process cartridge, and an image forming system within which such process cartridge can be removably mounted.

The image forming system may be, for example, a copying machine, laser beam printer, word processor, and the like, which are of the electrophotographic type or the electrostatic recording type.

2. Related Background Art

Conventionally, in image forming systems, process cartridges integrally including an image bearing member and process means (for example, a developing means), which are required for image formation, as a unit which can be removably mounted within an image forming system have been widely used in order to improve the maintenance of the image forming system (for example, refer to U.S. Pat. No. 3,985,436).

As to such process cartridges, the inventors invented a method or system wherein, in order to facilitate the assembling of a process cartridge, a developer containing portion is constituted by joining a plurality of members and seal members are obtained by applying to joined portions liquid sealing material, which can be solidified as an elastomer (high-molecular weight compound having elasticity)(U.S. Pat. No. 5,208,634).

An example of such process cartridge is shown in FIG. 1. FIG. 1 is an elevational sectional view of a process cartridge. The process cartridge 1 is constituted by integrally incorporating a photosensitive drum 2 as an image bearing member, and process means such as a cleaning device 3, a developing device 4, and a charger 5 into upper and lower frames A, B of the cartridge, and can be removably mounted within an image forming system. When a service life of the photosensitive drum 2 is expired or when toner in the developing device 4 is used up, the process cartridge is dismounted from the image forming system and a new process cartridge is mounted within the image forming system, thereby facilitating its maintenance.

Now, the contents of the above-mentioned U.S. Pat. No. 5,208,634 will be explained briefly.

The cleaning device 3 comprises a cleaning blade 30, a receiving sheet 31, a waste toner container 32, and the like. As shown in FIG. 2, by joining a portion A1 of the upper frame A to a portion B1 of the lower frame B via a seal member 13, the waste toner container 32 is assembled. In this way, the toner is prevented from leaking from the jointed areas between the upper and lower frames A, B by the seal member 13.

Further, the developing device 4 comprises a developing sleeve 40, a regulating blade 41, a toner container 42, and the like. As shown in FIG. 2, the toner container 42 is assembled by joining a portion A2 of the upper frame A to a portion B2 of the lower frame via a seal member 14. In this way, the toner is prevented from leaking from the jointed areas between the upper and lower frames A, B by the seal member 14. Incidentally, reference numeral 43 denotes an opening which is formed in the toner container. When the cartridge 1 is mounted within an image forming system 100, by previously removing a seal (not shown) from the opening 43, the toner can be supplied from the toner container toward the developing sleeve 40 through the opening.

As shown in FIG. 3, the seal members 13, 14 are formed by pouring liquid material, such as foam polyurethane rubber which can be solidified as an elastomer (high-molecular weight compound) from a nozzle 15 into grooves formed in surfaces C, D (to be jointed) of the upper frame A. The method for forming the seal members by pouring the liquid material which can be solidified as an elastomer (high-molecular weight compound) provides the greater advantages, in comparison with any methods for forming seal members by adhering foam rubber sheets and the like to frame portions, that the pouring operation can be automatically controlled and that it can be applied to complex configurations of the jointed areas.

However, it sometimes takes a relatively long time (for example, from several tens of seconds to several minutes) to solidify the liquid material. Thus, if it takes a long time to solidify the liquid material, for example, considering the portion A1 of the upper frame A as shown in FIGS. 4A and 4B, it is feared that the liquid material flows down along the inclined surface (to be jointed) while being solidified. Consequently, as shown in FIG. 4B, a thickness of the seal member 13 becomes thinner at an upper zone of the inclined surface and thicker at a lower zone, with the result that, when the portion A1 of the upper frame A is joined to the portion B1 of the lower frame B, it is feared that the seal member 13 is unevenly abutted against the portions A1, B1, thus causing leakage of toner from the jointed area. Further, if the seal member 13 is unevenly abutted against the portions A1, B1, the pressure of the seal member 13 acting on the portions A1, B1 of the upper and lower frames A, B at the jointed area also becomes uneven, thus deforming the upper and lower frames A, B, which results in the poor image and/or abnormal torque. Incidentally, FIGS. 5A and 5B are views looked at from directions shown by the arrows G in FIGS. 4A and 4B, respectively.

Now, a jointing structure for the toner container 42 is shown in FIGS. 6 to 9. As shown in FIG. 7, the toner container 42 is formed by joining the upper frame A to the lower frame B with the interposition of the seal member 14. As shown in FIG. 9, the seal member 14 is formed by pouring liquid material 14A, such as foam polyurethane rubber, which can be solidified as an elastomer from the nozzle 15 onto the surface C (to be joined) of the upper frame A. The method for forming the seal member by pouring the liquid material, which can be solidified as elastomer, provides the greater advantages, in comparison with any methods for forming seal members by adhering foam rubber sheets and the like to frame portions, that the pouring operation can be automatically controlled and that it can be applied to complex configurations of the jointed areas.

However, as shown in FIG. 6, if the liquid material 14A is poured to form a loop from a starting point as shown by a mark ○ to a finishing point as shown by a mark ● in a direction shown by the arrow, it is feared that the liquid material runs down at an overlapped area 14A-1. If such run-down of the liquid material occurs, the seal member 14 will be swollen at this overlapped area 14A-1. Consequently, when the upper frame A is jointed to the lower frame B, as shown in FIG. 7, it is feared that there will arise voids or clearances δ1, δ2 between these frames A and B.

Further, even if the run-down of the liquid material as mentioned above does not occur, as shown in FIGS. 8 and 9, it is feared that the liquid material 14A will be swollen or thickened at the overlapped portions 14A-1, 14A-2, thus causing the same problem as mentioned above.

SUMMARY OF THE INVENTION

An object of the present invention is to provide a process cartridge, a method for assembling such a process cartridge and an image forming system within which such a process cartridge can be mounted, which can prevent toner from leaking.

Another object of the present invention is to provide a process cartridge, a method for assembling such a process cartridge, and an image forming system within which such a process cartridge can be mounted, with an improved sealing characteristic.

A further object of the present invention is to provide a process cartridge, a method for assembling such a process cartridge and an image forming system within which such a process cartridge can be mounted, with an improved sealing characteristic.

A still further object of the present invention is to provide a process cartridge, a method for assembling such a process cartridge and an image forming system within which such a process cartridge can be mounted, which can surely prevent leakage of developer by improving the sealing characteristic between seal members disposed at jointed areas of a plurality of members constituting a developer containing portion and members to be abutted against the seal members.

The other object of the present invention is to provide a process cartridge, a method for assembling such a process cartridge and an image forming system within which such a process cartridge can be mounted, which can prevent leakage of developer, and the occurrence of poor image and/or abnormal torque due to the deformation of the cartridge frames, by improving the sealing ability between seal members disposed at jointed areas of a plurality of members constituting a developer containing portion and members to be abutted against the seal members.

DETAILED DESCRIPTION OF THE PREFERRED EMBODIMENTS

Figure 1:
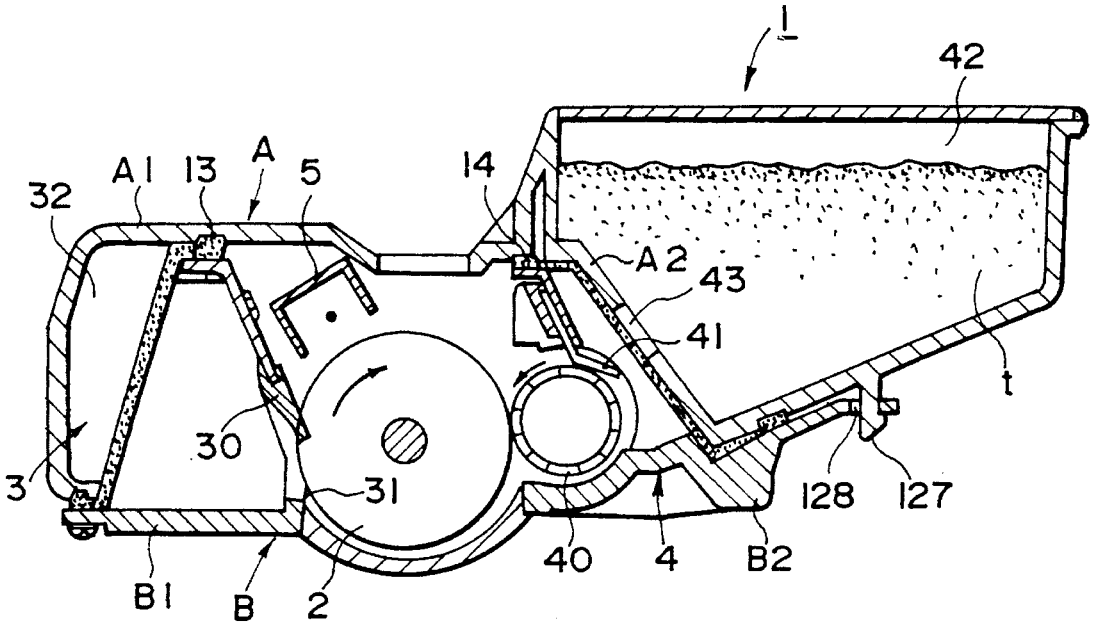
FIG. 1 is an elevational sectional view of a conventional process cartridge.

First of all, various embodiments of the present invention will be explained briefly.

In a first embodiment of the present invention which is applied to a process cartridge removably mountable with respect to an image forming system and having a developer containing portion formed by joining a plurality of members and seal members disposed at jointed areas between the members and comprising poured liquid material which can be solidified as an elastomer, liquid reservoirs or grooves are formed in surfaces of the members to be joined.

According to this first embodiment, since the overlapped portions of the liquid material reside in the liquid reservoirs and do not protrude from the surfaces to be joined, seal members each having an even thickness are formed on the surfaces (to be joined) of the members, with the result that surfaces of the seal members to be joined to corresponding members are kept flat, thus improving the degree of contact between the members to surely prevent the leakage of developer between the members.

In a second embodiment of the present invention which is applied to the above-mentioned process cartridge, the above-mentioned seal member is formed by overlapping a start portion and an end portion of the liquid material with each other in parallel on the surface (to be joined) of the member.

According to this second embodiment, since the start and end portions of the liquid material are overlapped laterally in parallel on the jointed surface (same surface) of the member, the seal member having the uniform thickness can be formed between the jointed surface of the members, thus providing the same advantages as those of the first embodiment.

In a third embodiment of the present invention which is applied to a process cartridge removably mountable with respect to an image forming system and having a developer containing portion formed by joining a plurality of members and seal members disposed at jointed areas between the members and comprising poured liquid material which can be solidified as an elastomer, indentations are formed on inclined surfaces of the members to be joined.

According to this third embodiment, when the liquid material is poured on the inclined surface of one of the members, the liquid material is prevented from flowing down along the inclined surface by the indentations while the liquid material is being solidified, whereby the uniform seal member is formed on the inclined surface of the member. As a result, the seal member is uniformly abutted against the interfaces of the joined members, thus improving the contactness between the members and the seal members to prevent the leakage of developer between the joined members and the deformation of the developer containing portion, with the result that the formation of the poor image and/or occurrence of the abnormal torque are prevented.

In a fourth embodiment of the present invention which is applied to the above-mentioned process cartridge, the inclination of the inclined surface of the member to be joined is increased from the top to the bottom.

According to this fourth embodiment, since the inclination of the liquid pouring groove formed in the inclined surface of the member is also increased from the top to the bottom, even if the thickness of the seal member is increased from the top to the bottom due to the run-down of the liquid material, the outer surface of the seal member (i.e., surface to be abutted against the other member) is kept flat, thus improving the degree of contact between both members, and, therefore, providing the same advantage as that of the third embodiment.

In a fifth embodiment of the present invention which is applied to the above-mentioned process cartridge, a liquid reservoir is formed in the inclined surface (to be joined) of the member at a lower portion thereof.

According to this fifth embodiment, when the liquid material is poured on the inclined surface of the member, the liquid material flowing down along the inclined surface while being solidified is received into the liquid reservoir not to protrude or swell, thus keeping the outer surface of the seal member (i.e., surface to be abutted against the other member) flat to improve the degree of contact between both members, and, therefore, to provide the same advantage as that of the third embodiment.

In a sixth embodiment of the present invention which is applied to the above-mentioned process cartridge, a volume of the liquid pouring groove formed in the inclined surface of the member is increased from the top to the bottom.

According to this sixth embodiment, since the volume of the liquid pouring groove is increased from the top to the bottom, even if the liquid material flows down along the groove, the outer surface of the seal member (i.e., surface to be abutted against the other member) is kept flat, thus improving the contactness between the members, and, therefore, providing the same advantage as that of the third embodiment.

Now, the above-mentioned embodiments of the present invention will now be fully explained with reference to the accompanying drawings.

Figure 2:
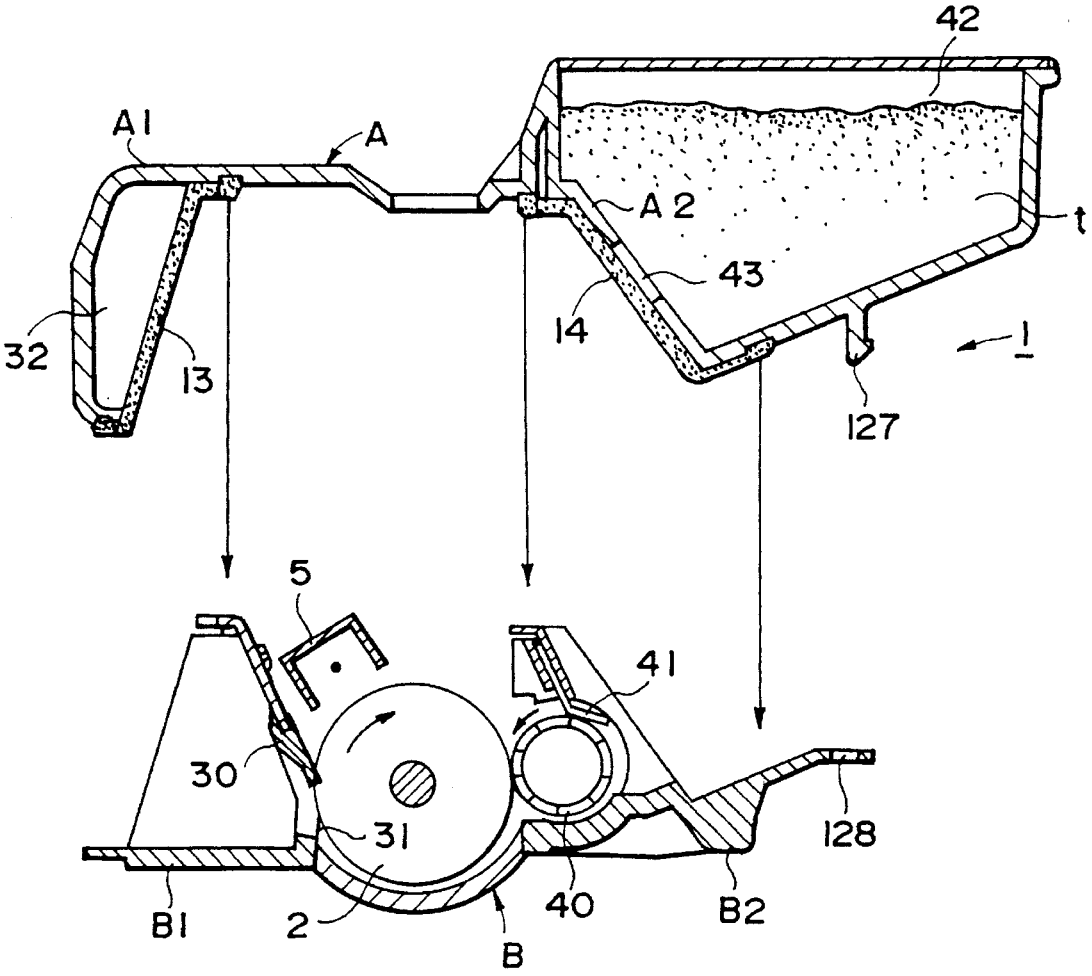
FIG. 2 is an exploded elevational sectional view for explaining the assembling of the process cartridge of FIG. 1.
Figure 3:
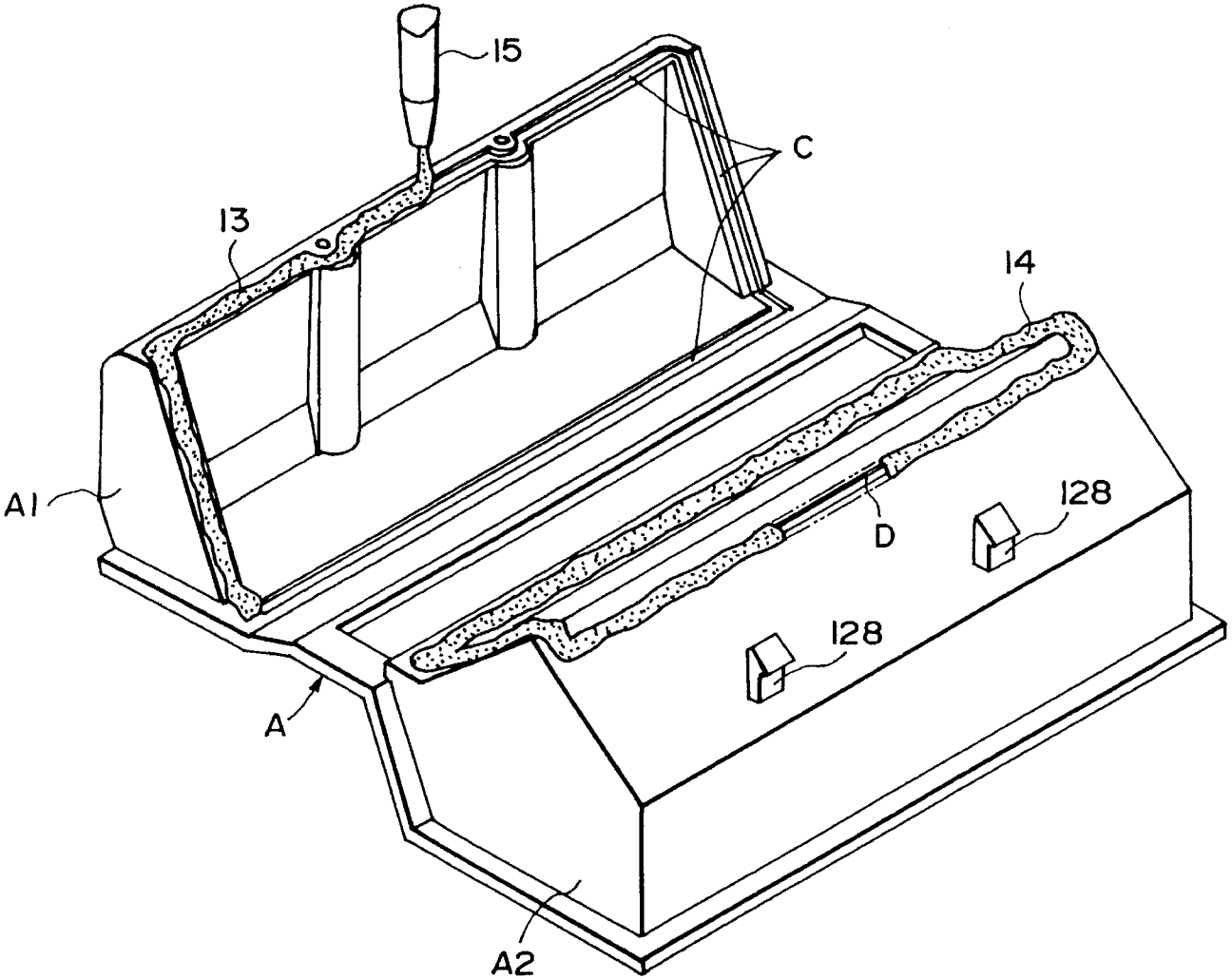
FIG. 3 a perspective view showing a condition that liquid material is poured to the process cartridge of FIG. 1.
Figure 4A:
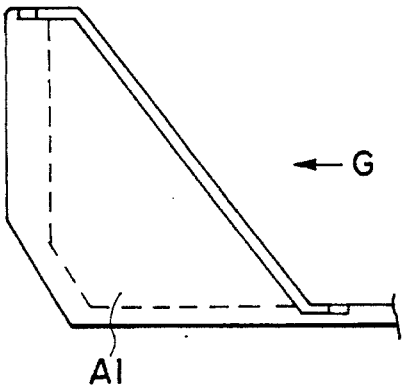
FIGS. 4A and 4B are sectional views of an upper frame of the process cartridge before and after the liquid material is poured, respectively.
Figure 4B:
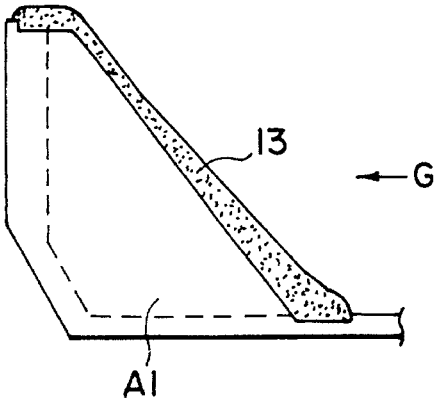
Figure 5A:
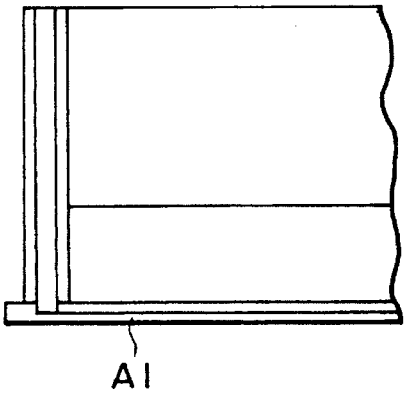
FIGS. 5A and 5B are views looked at from directions shown by arrows G shown in FIGS. 4A and 4B, respectively.
Figure 5B:
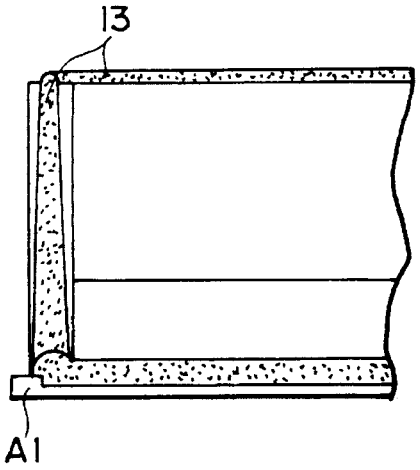
Figure 6:
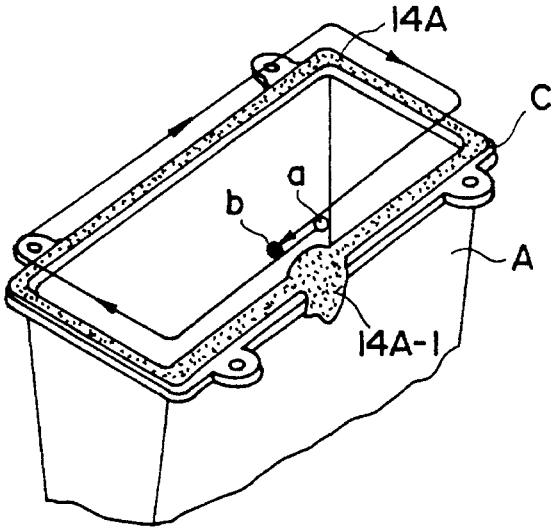
FIG. 6 is a partial perspective view of the upper frame of the process cartridge.
Figure 7:
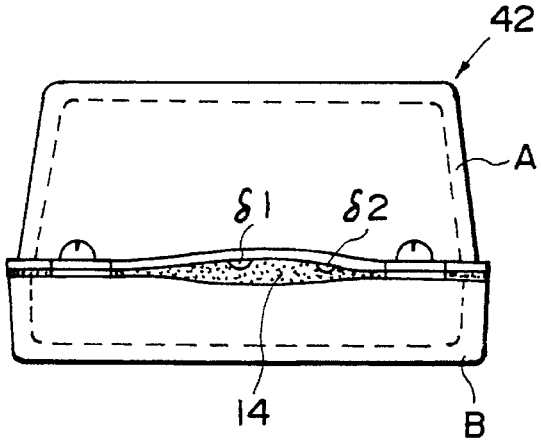
FIG. 7 is a front perspective view of a toner containing portion of the process cartridge.
Figure 8:
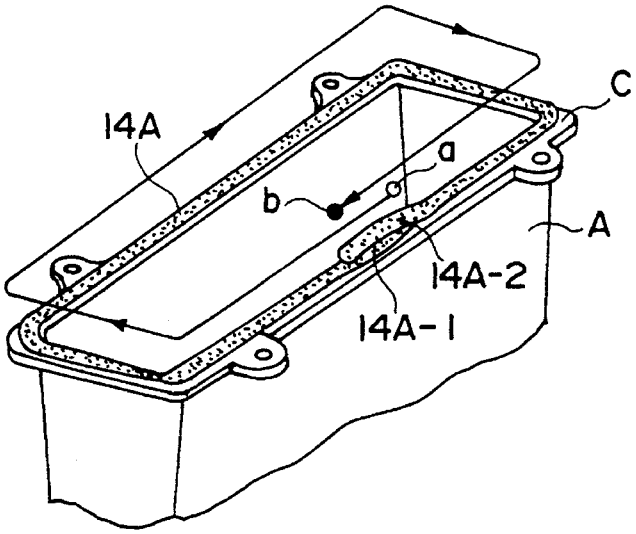
FIG. 8 is a partial perspective view of the upper frame of the process cartridge.
Figure 9:
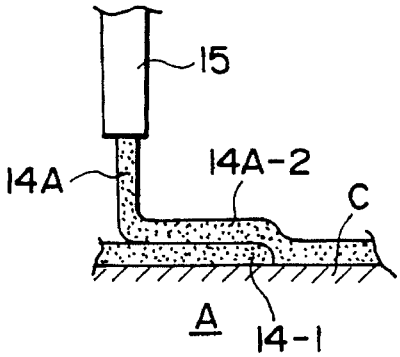
FIG. 9 is a partial sectional view showing an overlapped area of liquid material.
Figure 10:
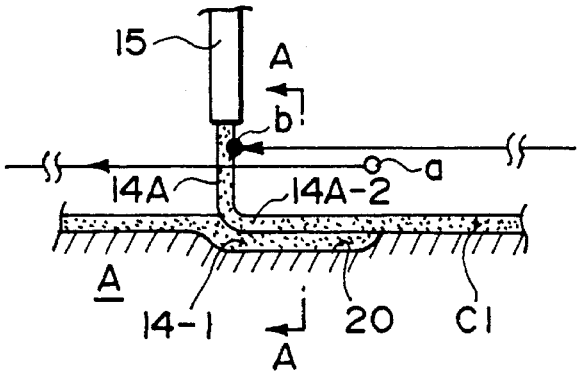
FIG. 10 is a partial sectional view of an upper frame of a process cartridge to which the present invention is applied.
Figure 11:
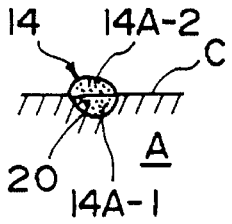
FIG. 11 is a sectional view taken along the line A—A in FIG. 10.
Figure 12:
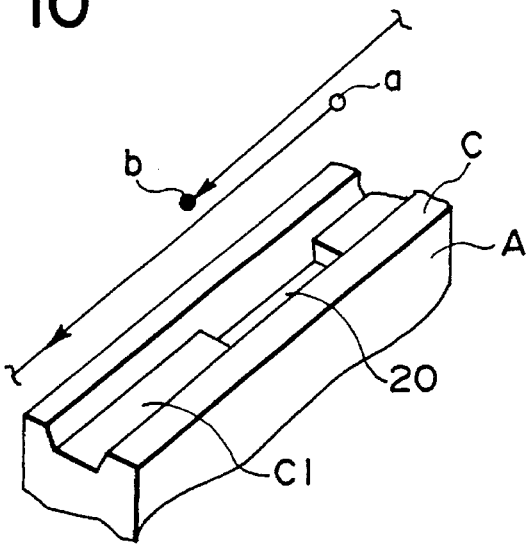
FIG. 12 is a partial perspective view of an upper frame of a process cartridge according to a first embodiment of the present invention.
Figure 13:
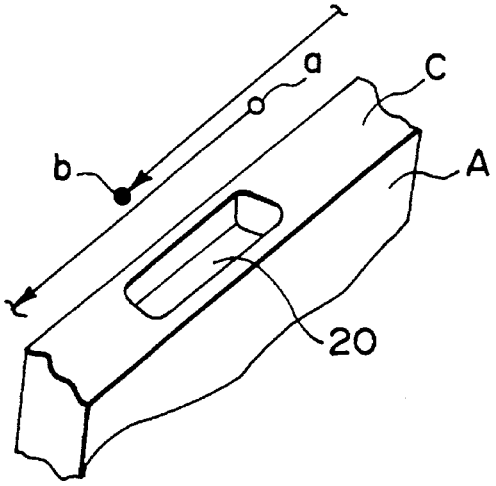
FIG. 13 is a partial perspective view showing an alteration of the embodiment of FIG. 12.
Figure 14:
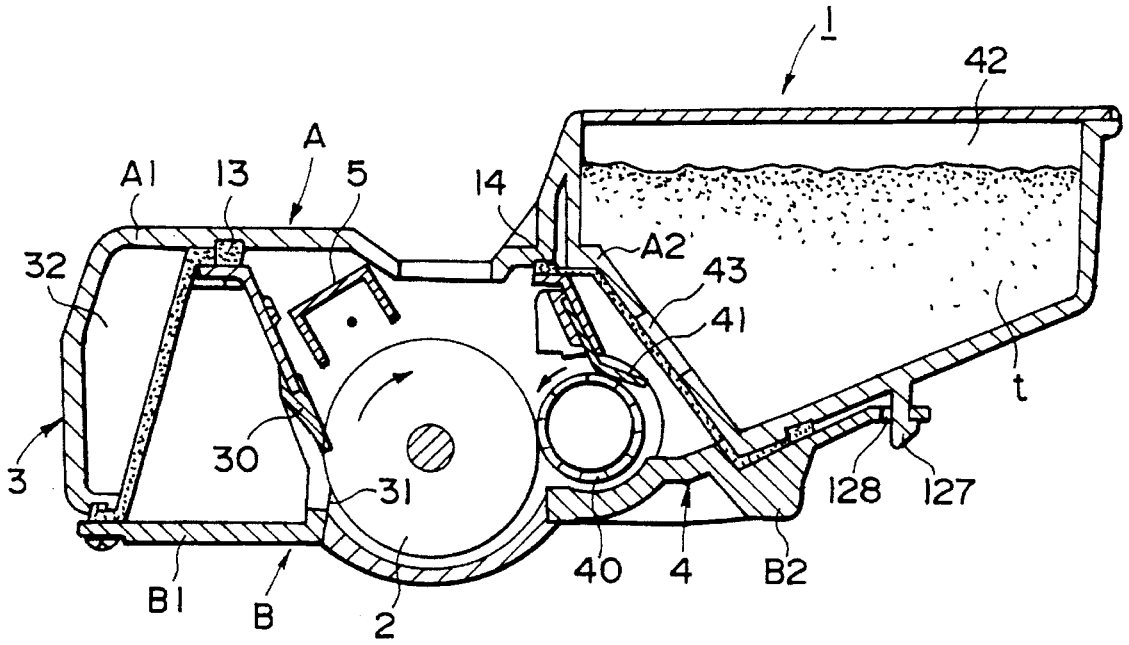
FIG. 14 is an elevational sectional view of the process cartridge of the first embodiment.

FIG. 10 is a partial sectional view of an upper frame of a process cartridge according to the above-mentioned first embodiment wherein the liquid reservoir is formed in the member to be joined, FIG. 11 is a sectional view taken along the line A—A in FIG. 10, FIGS. 12 and 13 are partial perspective views of the upper frame, and FIG. 14 is an elevational sectional view of the process cartridge according to this embodiment. Incidentally, the construction shown in FIGS. 1 to 3 is applied to the various embodiments of the present invention.

A process cartridge 1 shown in FIG. 14 is constituted by integrally incorporating a photosensitive drum 2 as an image bearing member, and process means such as a cleaning device 3, a developing device 4, and a charger 5 arranged around the drum into upper and lower frames A, B of the cartridge, and can be removably mounted within an image forming system which will be described later. When a service life of the photosensitive drum 2 is expired or when toner in the developing device 4 is used up, the process cartridge is dismounted from the image forming system and a new process cartridge is mounted within the image forming system, thereby facilitating its maintenance.

The cleaning device 3 comprises a cleaning blade 30 for removing waste toner from the photosensitive drum 2, a receiving sheet 31 for preventing the leakage of the removed waste toner toward the outside, a waste toner container 32 for collecting the waste toner, and the like. The waste toner container 32 is assembled by joining a portion A1 of the upper frame A to a portion B1 of the lower frame B via a seal member 13 during the assembling of the cartridge (FIG. 2). In this way, the toner is prevented from leaking from the jointed areas between the upper and lower frames A, B by the seal member 13 (FIG. 1).

The developing device comprises a developing sleeve 40 rotated in a direction shown by the arrow and adapted to feed the toner carried thereon toward the photosensitive drum 2, a regulating blade 41 for regulating a thickness of a toner layer carried on the developing sleeve 40, a toner container 42 containing the toner therein, and the like. The toner container 42 is assembled by joining a portion A2 of the upper frame A to a portion B2 of the lower frame B via a seal member 14 during the assembling of the cartridge (FIG. 2). In this way, the toner is prevented from leaking from the jointed areas between the upper and lower frames A, B by the seal member 14 (FIG. 1).

Now, in this first embodiment, as shown in FIG. 12, a concave liquid reservoir portion 20 is formed in a portion of a liquid pouring groove C1 formed in a surface C of the upper frame A to be joined. Alternatively, as shown in FIG. 13, a concave liquid reservoir portion 20 is directly formed in the connection surface C of the upper frame A.

As shown in FIG. 10, the seal member 14 is formed by pouring liquid material 14A such as foam polyurethane rubber from a nozzle 15 into the liquid pouring groove C1 of the connection surface C of the upper frame A in such a manner as to describe a closed loop (as shown in FIG. 3) from a start point a as shown by a mark ○ to an end point b as shown by a mark ● in a direction shown by the arrow. In this case, by positioning the concave liquid reservoir portion 20 at an area where an end portion 14A-2 is overlapped on a start portion 14A-1 of the liquid material 14A, the overlapped portions of the liquid material 14A are housed in the liquid reservoir 20 and do not protrude or swell. In this way, the seal member 14 having a uniform thickness is formed on the connection surface C of the upper frame A. As a result, an outer surface of the seal member 14 (i.e., surface to be abutted against the portion B2 (FIG. 14) of the lower frame B) is kept flat, thus improving the degree of contact between the portion A2 of the upper frame A and the portion B2 of the lower frame B to surely prevent the leakage of toner from the joined area.

Incidentally, a volume of the liquid reservoir portion 20 can be calculated and selected on the basis of the amount of the overlapped portions of the liquid material 14A.

While the formation of the seal member 14 during the assembling of the toner (or developer) container 42 of the developing device 4 was explained, the seal member 13 can be formed in the same manner as the formation of the seal member 14, during the assembling of the waste or residual toner (or developer) container 32 of the cleaning device 3. Thus, the explanation regarding the formation of the seal member 13 will be omitted (in the other embodiments of the present invention, too).

Figure 15:
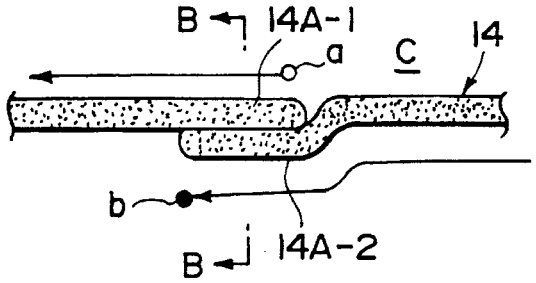
FIG. 15 is a partial plan view of a jointed surface of an upper frame of a process cartridge according to a second embodiment of the present invention.
Figure 16:
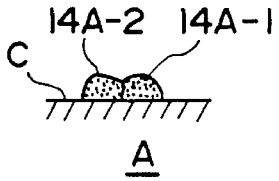
FIG. 16 is a sectional view taken along the line B—B in FIG. 15.

Next, the second embodiment of the present invention will be explained with reference to FIGS. 15 and 16. Incidentally, FIG. 15 is a partial plan view of a connection surface of an upper frame A of the process cartridge, and FIG. 16 is a sectional view taken along the line B—B in FIG. 15.

Also in this second embodiment, the seal member 14 is formed by pouring liquid material 14A such as foam polyurethane rubber on the connection surface C of the upper frame A in such a manner as to describe a closed loop from a start point a as shown by a mark ○ to an end point b as shown by a mark ● in a direction shown by the arrow. In this case, a start portion 14A-1 of the liquid material 14A is overlapped to an end portion 14A-2 laterally in parallel on the connection surface C (at the same level) of the upper frame A. With this arrangement, the seal member 14 having a uniform thickness is formed on the connection surface C of the upper frame A. As a result, an outer surface of the seal member 14 (i.e., surface to be abutted against the portion B2 (FIG. 14) of the lower frame B) is kept flat, thus improving the degree of contact between the portion A2 of the upper frame A and the portion B2 of the lower frame B during the assembling of the cartridge to surely prevent the leakage of toner from the joined area. Incidentally, this second embodiment is particularly effective in a case where the run-down of the liquid material 14A is not likely to occur while the liquid is being solidified. In a case where the run-down of the liquid material is likely to occur, it should be noted that the above-mentioned first and second embodiments may be combined.

Figure 17:
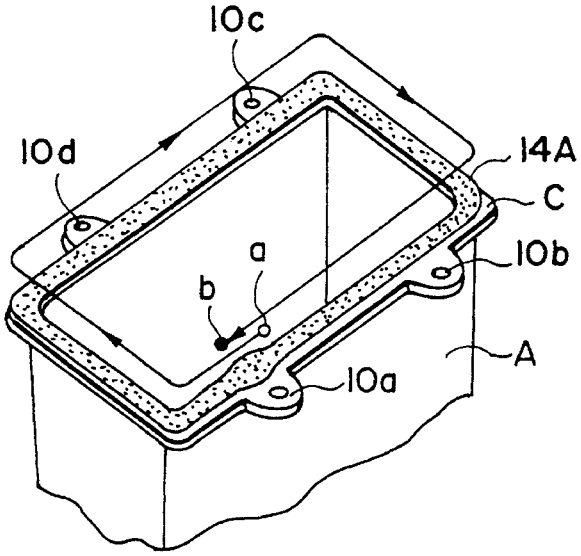
FIG. 17 is a partial perspective view of an upper frame having a fastening means.

If the thickness of the seal member cannot be made uniform completely even with the first and/or second embodiments, the arrangement as shown in FIG. 17 may be adopted. In this arrangement, screw receiving portions **10*a*, 10*b*, 10*c*, 10*d* are provided at positions situated in the proximity of a closed loop liquid pouring path starting from the start point a shown by the mark ○ and finishing to the end point b shown by the mark ● (including a position near the overlapped portions of the liquid material), and the upper and lower frames A and B are fastened to each other by threading screws (not shown) into the screw receiving portions 10*a*–10*d***.

According to this arrangement, even if the thickness of the seal member 14 is uneven more or less, since the uneven thickness of the seal member can be compensated or corrected by compressing the seal member by means of the screw fastening means, the contactness or sealing ability between the upper and lower frames is improved, thus surely preventing the leak of toner from the joined area. Incidentally, the liquid material which can be solidified as an elastomer may be soft rubber such as silicone rubber or soft plastics, as well as foam polyurethane rubber.

As mentioned above, according to the above first and second embodiments of the present invention, since the seal members having the uniform thickness are formed on the connection surfaces of the frame, the seal members are uniformly abutted against the connection surfaces of both frames (members), thus improving the degree of contact between the frames to surely prevent the leakage of toner from the joined areas.

Next, the third embodiment of the present invention will be explained with reference to FIGS. 18 and 19.

Figure 18:
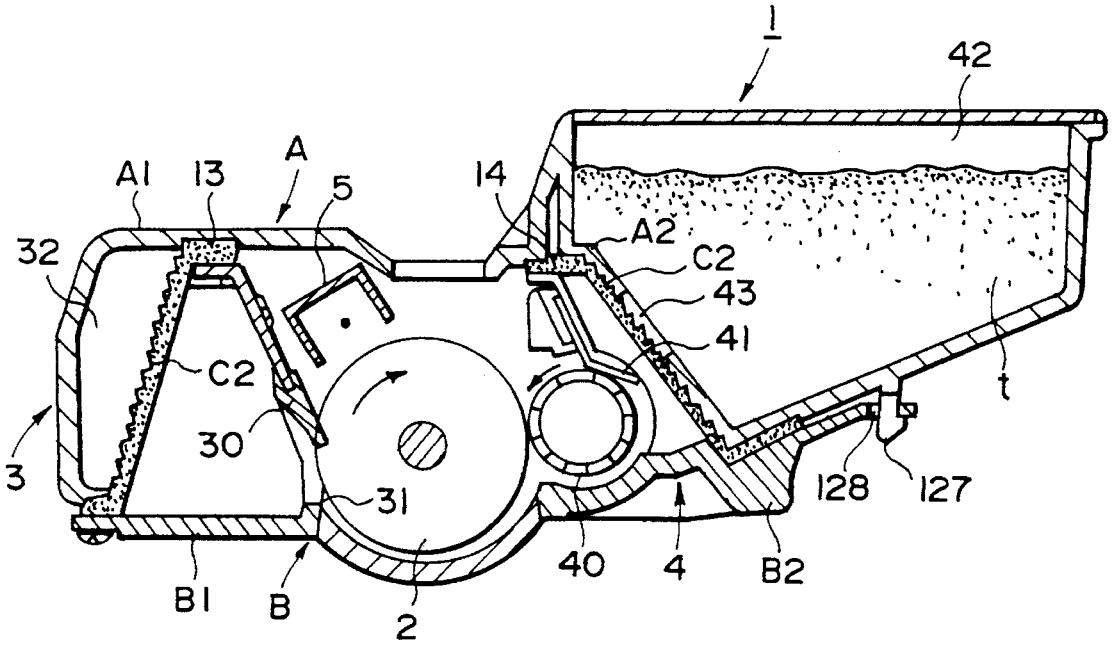
FIG. 18 is an elevational sectional view of a process cartridge according to a third embodiment of the present invention.
Figure 19:
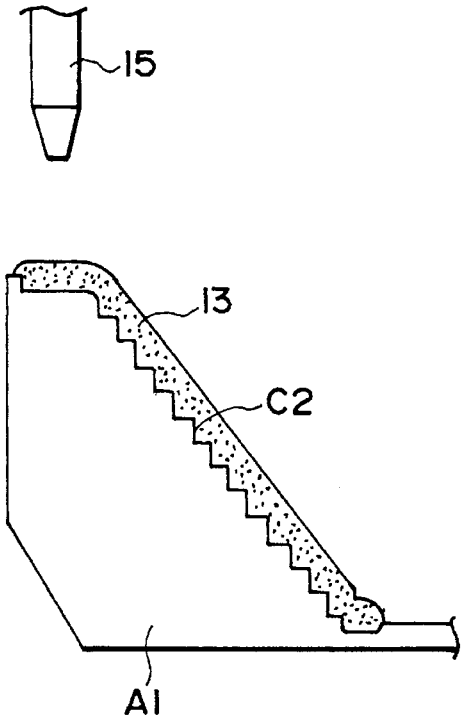
FIG. 19 is a partial sectional view of an upper frame of the process cartridge of FIG. 18 showing a poured liquid material.

Now, FIG. 18 is an elevational sectional view of a process cartridge according to the third embodiment, and FIG. 19 is a partial sectional view of an upper frame of the process cartridge on which liquid material was poured. Incidentally, the same constructural elements as those in the above embodiments are designated by the same reference numerals, and the detailed explanation thereof will be omitted.

Also in this third embodiment, the seal members 13, 14 are formed by pouring liquid material such as foam polyurethane rubber which can be solidified as an elastomer on the connection surfaces of the upper frame A, as in FIG. 3.

Now, the formation of the seal member 13 during the assembling of the waste toner container 32 of the cleaning device 3 will be described with reference to FIG. 19. In this embodiment, step-shaped indentations C2 are formed on an inclined connection surface of the portion A1 of the upper frame A. Accordingly, when the liquid material is poured from the nozzle 15 on the inclined connection surface of the frame A, the run-down of the liquid material along the inclined connection surface is regulated by the indentations C2 while the liquid is being solidified as elastomer, thus forming the uniform seal member 13 on the inclined connection surface of the upper frame A. As a result, the seal member 13 is uniformly abutted against the portion B1 of the lower frame B, thus improving the contactness or sealing ability between the portions A1 and B1 of the frames to surely prevent the leakage of toner from the joined areas.

Incidentally, while the formation of the seal member 13 during the assembling of the waste toner container 32 of the cleaning device 3 was explained, the seal member 14 can be formed in the same manner as the formation of the seal member 13, during the assembling of the toner container 42 of the developing device 4. Thus, the explanation regarding the formation of the seal member 14 will be omitted (in the embodiments described hereinbelow, too).

Figure 20:
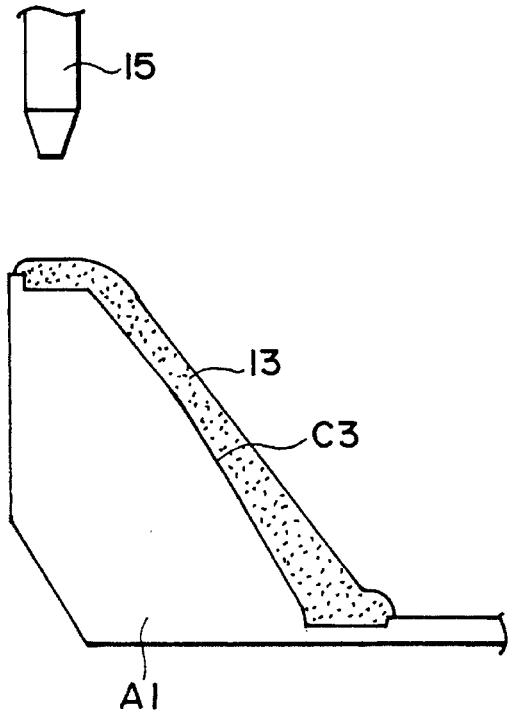
FIG. 20 is a partial sectional view of an upper frame of a process cartridge according to a fourth embodiment of the present invention, showing a poured liquid material.

In the above-mentioned fourth embodiment shown in FIG. 20 similar to FIG. 19, a liquid pouring groove C3 formed in the inclined connection surface of the portion A1 of the upper frame A has the inclination increasing from the top to the bottom thereof.

When the liquid material such as foam polyurethane rubber is poured from the nozzle 15 into the liquid pouring groove C3 of the upper frame A, even if it takes a relatively long time (for example, several tenth seconds to several minutes) to solidify the liquid material as an elastomer (seal member 13), the liquid material will flow down along the liquid pouring groove C3. In this case, as mentioned above, since the inclination of the liquid pouring groove is increased from the top to the bottom, even when the thickness of the liquid material flowed down is increased from the top to the bottom, the outer surface of the seal member 13 (i.e., surface to be abutted against the connection surface of the portion B1 of the lower frame B) is kept flat as shown, thus improving the degree of contact between the portion A1 of the upper frame A and the portion B1 of the lower frame B, and, therefore, providing the same advantage as the third embodiment.

Figure 21:
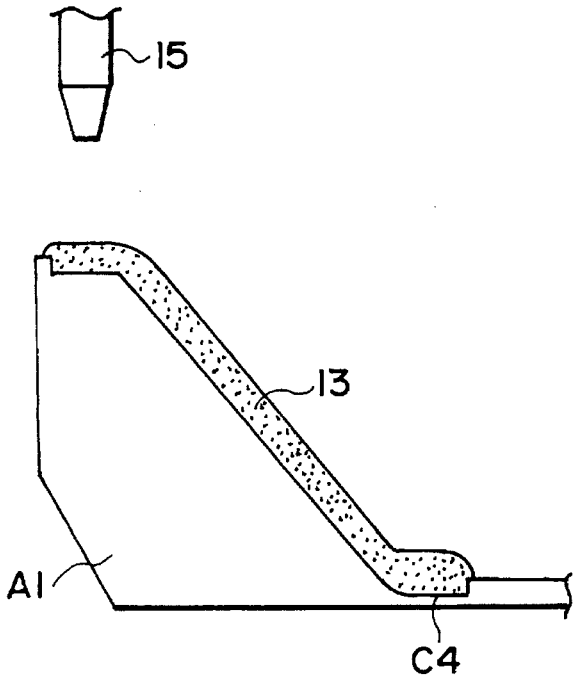
FIG. 21 is a partial sectional view of an upper frame of a process cartridge according to a fifth embodiment of the present invention, showing a poured liquid material.

FIG. 21 shows the above-mentioned fifth embodiment of the present invention. In this embodiment, a liquid reservoir C4 is formed in the inclined connection surface of the portion A1 of the upper frame A at a lower portion thereof.

During the assembling of the process cartridge, when the liquid material such as foam polyurethane rubber is poured from the nozzle 15 on the inclined connection surface of the frame A, the liquid material flowing down along the inclined connection surface while being solidified is received in the liquid reservoir C4, thus preventing the liquid material from swelling. As a result, the outer surface of the seal member 13 (i.e., surface to be abutted against the portion B1 of the lower frame B) is kept flat as shown. Accordingly, also in this embodiment, the contactness or sealing ability between the portion A1 of the upper frame A and the portion B1 of the lower frame B is improved, thereby providing the same advantage as that of the third embodiment.

Figure 22A:
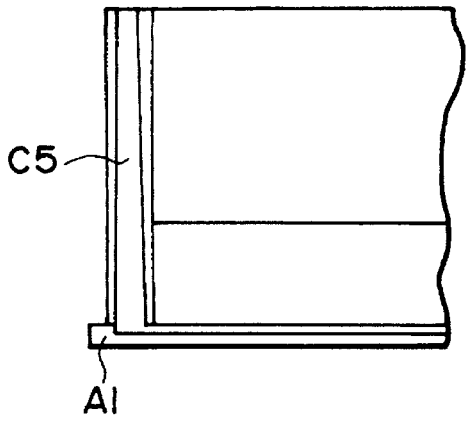
FIGS. 22A and 22B are plan views showing a liquid material pouring groove formed in an inclined surface (to be jointed) of an upper frame of a process cartridge according to a sixth embodiment of the present invention, before and after liquid material is poured into the groove, respectively.
Figure 22B:
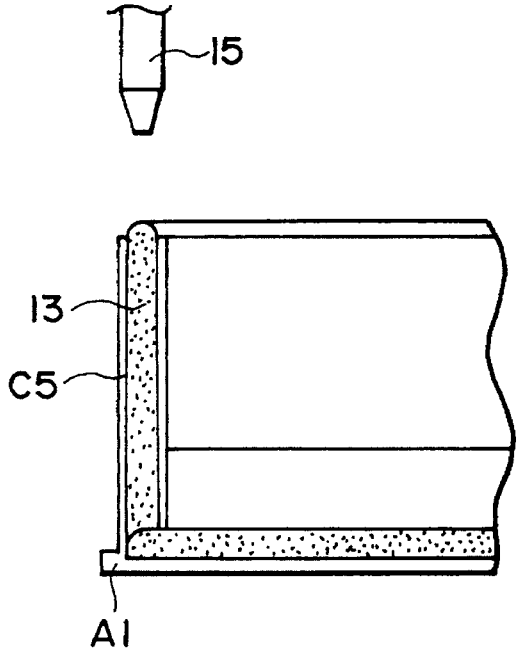

Next, the above-mentioned sixth embodiment of the present invention is shown in FIGS. 22A and 22B. Incidentally, FIGS. 22A and 22B are plan views showing a liquid pouring groove C5 formed in the inclined connection surface of the portion A1 of the upper frame A before and after the liquid material is poured in the groove.

In this sixth embodiment, as shown in FIG. 22A, a width of the liquid pouring groove C5 is increased from the top to the bottom of the inclined connection surface. Incidentally, although not shown, a depth of the liquid pouring groove C5 is constant through its whole length. Accordingly, a volume of the liquid pouring groove C5 is increased from the top to the bottom.

During the assembling of the process cartridge 1, when the liquid material such as foam polyurethane rubber is poured from the nozzle 15 in the liquid pouring groove C5, the liquid material flows down along the liquid pouring groove C5 until it is solidified as elastomer (seal member 13). However, as mentioned above, since the volume of the liquid pouring groove C5 is so selected as to increase from the top to the bottom, the outer surface of the seal member 13 (i.e., surface to be abutted against the portion B1 of the lower frame B) is kept flat as shown. Accordingly, also in this embodiment, the degree of contact or sealing ability between the portion A1 of the upper frame A and the portion B1 of the lower frame B is improved, thereby providing the same advantage as that of the third embodiment.

Incidentally, the liquid material which can be solidified as elastomer may be soft rubber, such as silicone rubber or soft plastics, as well as the foam polyurethane rubber.

As mentioned above, according to the above third to sixth embodiments of the present invention, since the seal members having the uniform thickness are formed on the connection surfaces of the frame, the seal member are uniformly abutted against the connection surfaces of both frames (members), thus improving the degree of contact between the frames to surely prevent the leakage of developer from the joined areas and to prevent the deformation of the developer container, with the result that the formation of the poor image and/or occurrence of the abnormal torque are prevented.

Incidentally, in the above-mentioned various embodiments of the present invention, in order to fasten the upper frame A to the lower frame B, any fastening means such as screw fastening means as shown in FIG. 17, or elastic snap fastening means comprising elastic hooks 127 formed on the upper frame A and corresponding holes 128 adapted to receive the hooks and formed in the lower frame B, as shown in FIGS. 1–3, 14, 18 and 24 may be used independently or in combination.

Further, in the above-mentioned various embodiments of the present invention, as shown in FIG. 2, the toner container 42 is formed in the upper frame A, and the photosensitive drum 2, cleaning blade 30, charger 5 and developing sleeve 40 are housed in the lower frame B. By joining the upper frame A to the lower frame B to assemble the cartridge 1, the waste toner container 32 of the cleaning device 3 and the toner container 42 of the developing device 4 are formed.

By the way, in the above-mentioned various embodiments of the present invention, while an example that the liquid material which can be solidified as an elastomer is poured in seal spaces or on the connection surfaces was explained, now, a liquid pouring system wherein two reactive liquid components are mixed and the mixture is discharged from the nozzle 15 to form the elastomer will be explained with reference to FIG. 23.

Figure 23:
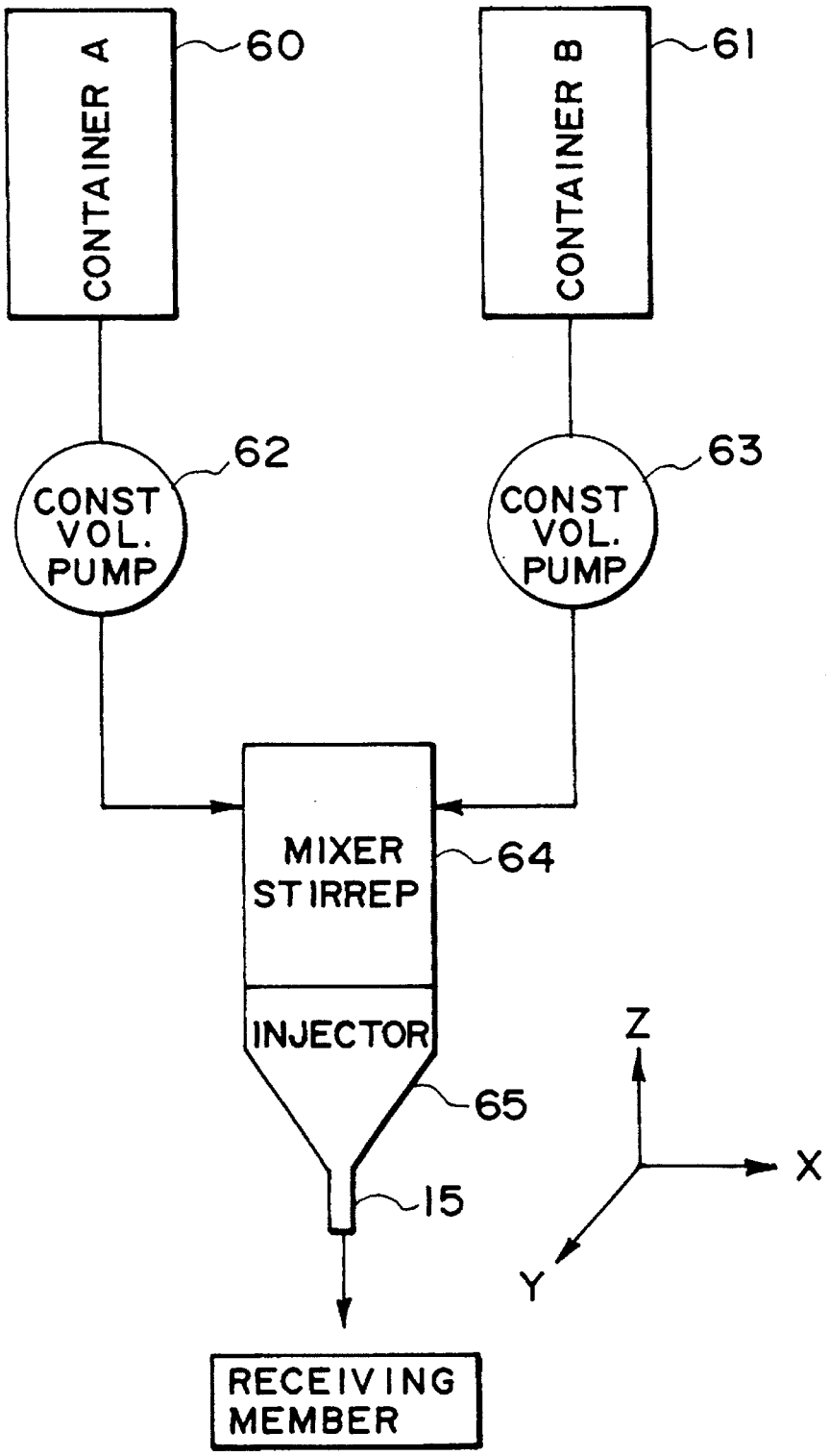
FIG. 23 is a schematic constructural view showing a liquid pouring system.

In FIG. 23, liquid A and liquid B contained in a container A60 and a container B60, respectively, are sent to a mixer/stirrer 64 by means of precision constant volume pumps 62, 63, respectively to obtain the optimum mixing rate between two liquids. In the mixer/stirrer 64, the liquid A and the liquid B are forcibly agitated and uniformly mixed by a motor. Since at least about 30 seconds are required to solidify these two liquids as an elastomer by reaction, the mixture is discharged from the nozzle 15 of an injector portion 65 as liquid material before the reaction is completed. A pouring head comprising the mixer/stirrer 64, injector portion 65 and nozzle 15 is shifted to three dimensional directions X, Y, Z in accordance with the configuration of the above-mentioned container and the like to pour the liquid material on the frame constituting the container.

The measurement of the mixing rate between two liquids A, B from the constant volume pumps 62, 63, the speed of the mixing and agitating of the liquids, the moving path of the pouring head in the directions X, Y, Z, the pouring speed and the like are controlled properly on the basis of the contents previously programmed in a controller of an industrial robot (not shown) so that the pouring operation can be performed automatically.

Regarding the materials so poured, in the above-mentioned various embodiments of the present invention, for example, the following material I or II may be appropriately selected and used.

| | A liquid (Main component) | B liquid | Foam magnification (Volume ratio) | Solidified elastomer |
|---|---|---|---|---|
| I | Polyol | Isocyanate | 2–5 | Foam polyurethane (made by Inoac Corp.) |
| | Mixing ratio between A and B | 10:2–3 | | |
| II | (—OH) silicone | (—H) silicone | 2–10 | Foam silicone (made by Toray Silicone Co., Ltd.) |
| | Mixing ratio between A and B | 1:1 | | |

Next, a liquid pouring system wherein, in place of the two reactive liquid components, single reactive liquid is mixed with $N_2$ gas to forcibly swell the material and the mixture is discharged from the nozzle 15 as liquid material will be explained with reference to FIG. 24.

Figure 24:
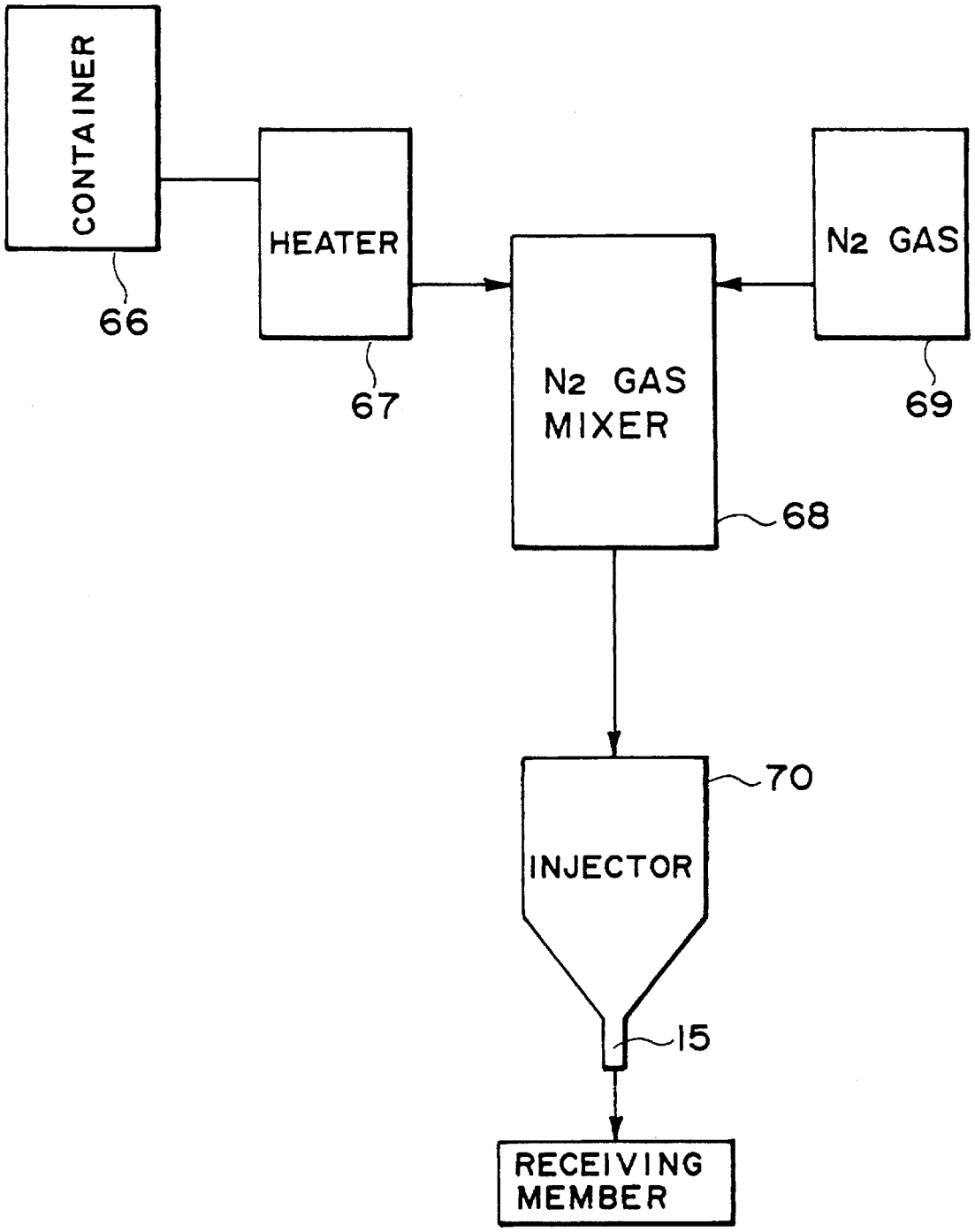
FIG. 24 is a schematic constructural view showing another liquid pouring system.

In FIG. 24, liquid material having polyurethane as a main component is discharged from a container 66 to a foam mixer 68 by a pump while heating the material to a temperature of about 70° C.–100° C. by a heater 67. In the foam mixer 68, the heated liquid material from the container 66 is mixed with $N_2$ gas from an $N_2$ gas source 69 to effect the foam reaction. The mixture is discharged from the nozzle 15 of an injector 70 as liquid material on the frame constituting the container and the like before the liquid material is solidified.

As in the case of the two reactive liquid components, the mixing of the $N_2$ gas, the feeding of the liquid material, the moving path of the pouring head in the directions X, Y, Z, the pouring speed and the like are controlled properly on the basis of the contents previously programmed in a controller of an industrial robot (not shown) so that the pouring operation can be performed automatically.

Such a one-component reactive liquid can be used as the liquid material associated with the present invention. In any case, the property of the elastomer in the illustrated embodiments has preferably elongation of 100–200%, hardness (Asker C) of 4–15, and compression restoring ability of 90% or more, and has preferably the sufficient elasticity to act as the seal member.

Incidentally, in the illustrated embodiments, while the elastomer made of foam material was used as the seal members, the elastomer is not limited to the foam material, but may be made from soft rubber, soft plastics, or the like.

Next, as an example of image forming systems within which the process cartridges according to the illustrated embodiments, an electrophotographic copying machine will be explained.

Figure 25:
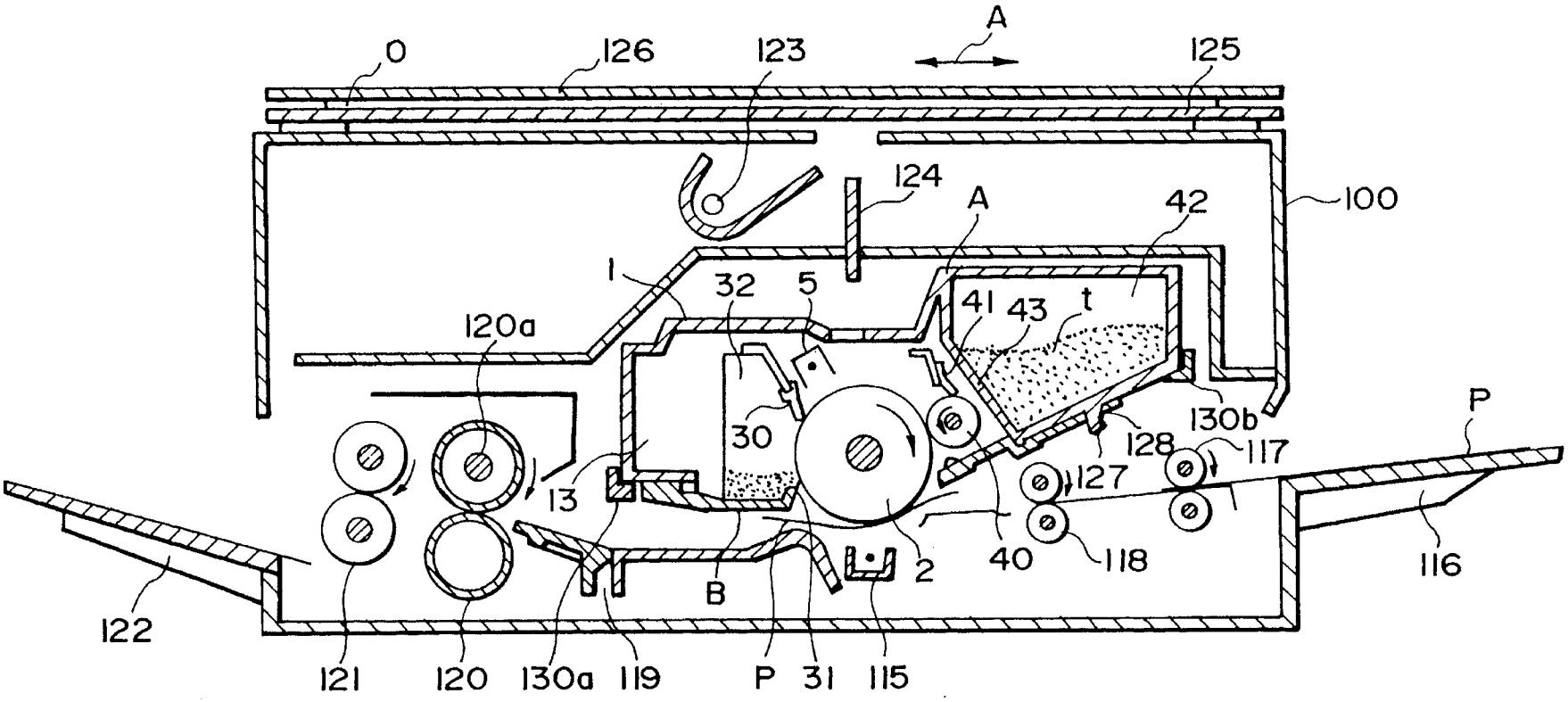
FIG. 25 is an elevational sectional view of an electrophotographic copying machine within which a process cartridge according to the present invention is mounted.

FIG. 25 is an elevational sectional view of such an electrophotographic copying machine within which the process cartridge 1 is mounted. Incidentally, in FIG. 25, the seal members of the process cartridge is omitted from illustration.

The electrophotographic copying machine or image forming system 100 a transfer charger 115 which is positioned below the photosensitive drum 2 in the process cartridge 1 when the process cartridge is mounted within the image forming system. A sheet supply tray 116, a sheet supply roller 117 and a pair of register rollers 118 are disposed at an unstream side of the transfer charger 115 in a sheet feeding direction; whereas, a sheet guide 119, a fixing device 120, a pair of ejector rollers 121 and an ejection tray 122 are disposed at a downstream side of the transfer charger 115 in the sheet feeding direction.

Further, above the process cartridge 1 mounted within the image forming system, there are arranged a lighting lamp 123 for illuminating an original 0, and a short focus optical element array 124 for directing image light reflected from the original 0 illuminated by light from the lighting lamp 123 to the photosensitive drum 2. Further, a transparent original support 125 reciprocable in directions shown by the arrow A is disposed on the image forming system. Incidentally, the reference numeral 126 denotes an original cover.

When the image light reflected from the original 0 illuminated by the light from the lighting lamp 123 via the short focus optical element array 124 on the photosensitive drum 2 uniformly charged by the charger 5, an electrostatic latent image corresponding to original information is formed on the photosensitive drum 2. The electrostatic latent image is brought to a position confronting to the developing sleeve 40 of the developing device 4 in consequence of the rotation of the photosensitive drum 2, where the latent image is developed with toner from the developing device 4 as a toner image. On the other hand, a recording sheet P is fed from the sheet supply tray 116 to the register rollers 118 by the sheet supply roller 117, and is then sent to a transfer station between the photosensitive drum 2 and the transfer charger 115 by the register rollers 118 in registration with the toner image formed on the photosensitive drum. At the transfer station, the toner image is transferred from the photosensitive drum 2 onto the recording sheet P by the transfer charger 115. The recording sheet P carrying the transferred toner image thereon is sent to the fixing device 120 (including a heat roller **120*a*), where the toner image is permanently fixed to the recording sheet. Thereafter, the recording sheet is ejected onto the ejection tray 122 by the ejector rollers 121. On the other hand, after the transferring operation, the residual toner remaining on the photosensitive drum 2 is removed by the cleaning blade 30 of the cleaning device 3, thereby preparing for the next image formation. Incidentally, the reference numerals 130*a*, 130*b* denote guides acting as mounting means for mounting the process cartridge 1 within the image forming system 1**.

Incidentally, the above-mentioned process cartridge integrally incorporates therein an electrophotographic photosensitive member as an image bearing member, and at least one of process means such as a charger means, a developing means and a cleaning means as a unit which can be removably mounted within an image forming system. More specifically, the process cartridge integrally incorporates therein a charger means, a developing means or a cleaning means, and an electrophotographic photosensitive member as a unit which can be removably mounted within an image forming system (for example, copying machine, laser beam printer LBP and the like); or integrally incorporates therein at least one of process means such as a charger means, a developing means and a cleaning means, and an electrophotographic photosensitive member as a unit which can be removably mounted within an image forming system (for example, copying machine, laser beam printer (LBP) and the like); or integrally incorporates therein at least a developing means and an electrophotographic photosensitive member as a unit which can be removably mounted within an image forming system (for example, copying machine, laser beam printer (LBP) and the like).

As mentioned above, according to the present invention, it is possible to provide a process cartridge and an image forming system within which such a process cartridge can be mounted, which improve the sealing ability against the leak of toner.

What is claimed is:

1. A process cartridge removably mountable to an image forming system, said process cartridge comprising:

an electrophotographic photosensitive member;

process means acting on said electrophotographic photosensitive member;

a first member, which forms a part of a developer container for containing a developer, said first member having an inclined connection surface;

a second member, which forms a part of said developer container for containing the developer, said second member having an inclined connection surface;

a seal member obtained by solidifying a liquid sealing material to produce an elastomer on said inclined connection surfaces at which said first member and said second member are joined to each other; and delaying means, provided on at least one of the inclined connection surface of said first member and the inclined connection surface of said second member, for delaying flow-down of the liquid sealing material on the at least one inclined connection surface.

2. A process cartridge according to claim 1, wherein said delaying means is provided on said inclined connection surface of said first member.

3. A process cartridge according to claim 1, wherein said delaying means is provided on said inclined connection surface of said first member and comprises indentations.

4. A process cartridge according to claim 1, wherein said delaying means is provided on said inclined connection surface of said first member and has a stepped configuration.

5. A process cartridge according to claim 1, wherein said delaying means comprises a liquid reservoir formed in a lower portion of said inclined connection surface of said first member.

6. A process cartridge according to any one of claims 1 through 5, wherein said first member comprises an upper frame of said process cartridge and said upper frame includes said developer container for containing the developer used in a developing operation.

7. A process cartridge according to any one of claims 1 through 5, wherein said second member comprises a lower frame of said process cartridge and said lower frame includes an electrophotographic photosensitive drum as said electrophotographic photosensitive member, a cleaning blade, and a developing sleeve disposed therein.

8. A process cartridge according to claim 1, wherein a pouring path for the liquid sealing material forms a closed loop.

9. A process cartridge according to claim 1, wherein said liquid sealing material is selected from the group consisting of: foam rubber, soft rubber, and soft plastics.

10. A process cartridge according to claim 1, wherein said developer container contains developer used in a developing operation.

11. A process cartridge according to claim 1, further comprising cleaning means, wherein said developer container contains developer removed from said electrophotographic photosensitive member by said cleaning means.

12. A process cartridge according to claim 1, wherein said process cartridge integrally incorporates therein a charger means, a developing means or a cleaning means as said process means, and an electrophotographic photosensitive drum as said electrophotographic photosensitive member, as a unit which can be removably mounted within the image forming system.

13. A process cartridge according to claim 1, wherein said process cartridge integrally incorporates therein at least one of said process means such as a charger means, a developing means or a cleaning means, and said electrophotographic photosensitive member, as a unit which can be removably mounted to the image forming system.

14. A process cartridge according to claim 1, wherein said process cartridge integrally incorporates therein at least a developing means as said process means, and said electrophotographic photosensitive member, as a unit which can be removably mounted to the image forming system.

15. An image forming system for forming an image on a recording medium, said image forming system comprising:

mounting means for removably mounting a process cartridge;

a process cartridge including an electrophotographic photosensitive member, a process means acting on said electrophotographic photosensitive member, a first member, which forms a part of a developer container for containing a developer, said first member having an inclined connection surface, a second member, which forms a part of said developer container for containing the developer, said second member having an inclined connection surface, a seal member obtained by solidifying a liquid sealing material to produce an elastomer on the inclined connection surfaces at which said first member and said second member are joined to each other, and a delaying means provided on at least one of the inclined connection surface of said first member and the inclined connection surface of said second member for delaying a flow-down of the liquid sealing material on the at least one connection surface; and conveying means for conveying the recording medium.

16. An image forming system according to claim 15, wherein said image forming system comprises a copying machine.

17. An image forming system according to claim 15, wherein said image forming system comprises a laser beam printer.

18. An image forming system according to claim 15, wherein said image forming system comprises a facsimile.

19. An image forming system according to claim 15, wherein said liquid sealing material is selected from the group consisting of: foam rubber, soft rubber, and soft plastics.

20. A process cartridge removably mountable to an image forming system, said process cartridge comprising:

an electrophotographic photosensitive member;

process means acting on said electrophotographic photosensitive member;

a first member which forms a part of a developer container for containing developer, said first member having a connection surface;

a second member which forms a part of said developer container for containing the developer, said second member having a connection surface; and a seal member obtained by solidifying a liquid sealing material to produce an elastomer on the connection surfaces at which said first member and said second member are joined to each other;

wherein said connection surfaces at which said first member and said second member are joined to each other are inclined, and said connection surface of said first member is provided with a liquid sealing material receiving groove for receiving the liquid sealing material, and wherein a volume of said groove being increased from a top to a bottom of said groove.

21. A process cartridge according to claim 20, wherein said first member comprises an upper frame of said process cartridge and said upper frame includes said developer container for containing the developer to be used in a developing operation.

22. A process cartridge according to claim 20 or 21, wherein said second member comprises a lower frame of said process cartridge and said lower frame includes an electrophotographic photosensitive drum as said electrophotographic photosensitive member, a cleaning blade, and a developing sleeve disposed therein.

23. A process cartridge according to claim 20, wherein a pouring path for the liquid sealing material forms a closed loop.

24. A process cartridge according to claim 20, wherein said liquid sealing material is selected from the group consisting of: foam rubber, soft rubber, and soft plastics.

25. A process cartridge according to claim 20, wherein said developer container contains developer to be used in a developing operation.

26. A process cartridge according to claim 20, further comprising a cleaning means, wherein said developer container contains developer removed from said electrophotographic photosensitive member by said cleaning means.

27. A process cartridge according to claim 20, wherein said process cartridge integrally incorporates therein a charger means, a developing means or a cleaning means as said process means, and said electrophotographic photosensitive member, as a unit which can be removably mounted within the image forming system.

28. A process cartridge according to claim 20, wherein said process cartridge integrally incorporates therein a charger means, a developing means or a cleaning means as said process means, and said electrophotographic photosensitive member, as a unit which can be removably mounted to the image forming system.

29. A process cartridge according to claim 20, wherein said process cartridge integrally incorporates therein at least a developing means as said process means, and said electrophotographic photosensitive member, as a unit which can be removably mounted to the image forming system.

30. A process cartridge according to claim 20, further comprising a resilient engagement piece formed at an opening portion of the process cartridge, wherein the connecting between said first member and second member is carried out by engaging said resilient engagement piece.

31. A process cartridge according to claim 20, wherein said developer container contains a developer to be used by said process means.

32. A process cartridge according to claim 20, wherein said developer container contains a developer removed from said electrophotographic photosensitive member, and wherein said process means comprises a cleaning means.

33. A process cartridge according to claim 20, wherein said process means comprises a developing means.

34. A process cartridge according to claim 20, wherein said process means comprises a cleaning means.

35. A process cartridge according to claim 20, wherein said process means comprises a charging means.

36. A method for assembling a process cartridge removably mountable within an image forming system, wherein said process cartridge comprises:

an electrophotographic photosensitive member;

process means acting on said electrophotographic photosensitive member;

a first member which forms a part of a developer container for containing developer, said first member having a connection surface; and a second member which forms a part of said developer container for containing the developer, said second member having a connection surface;

the method comprising the steps of:

forming a seal member by pouring a liquid sealing material, which solidifies to produce an elastomer, on said connection surfaces of said first member and said second member, overlapping pouring start and end portions of said material being in parallel; and joining said first member to said second member.

37. A method according to claim 36, wherein said first member comprises an upper frame of said process cartridge and said upper frame includes said developer container for containing the developer to be used in a developing operation.

38. A method according to claim 36 or 37, wherein said second member comprises a lower frame of said process cartridge and said lower frame includes an electrophotographic photosensitive drum as said electrophotographic photosensitive member, a cleaning blade, and a developing sleeve disposed therein.

39. A method according to claim 36, wherein a pouring path for the liquid sealing material forms a closed loop.

40. A method according to claim 36, wherein said liquid sealing material is selected from the group consisting of: foam rubber, soft rubber, and soft plastics.

41. A method according to claim 36, wherein said developer container contains developer to be used in a developing operation.

42. A method according to claim 36, further comprising a cleaning means, wherein said developer container contains developer removed from said electrophotographic photosensitive member by said cleaning means.

43. A method according to claim 36, wherein said process cartridge integrally incorporates therein a charger means, a developing means or a cleaning means as said process means, and said electrophotographic photosensitive member, as a unit which can be removably mounted within the image forming system.

44. A method according to claim 36, wherein said process cartridge integrally incorporates therein a charger means, a developing means or a cleaning means as said process means, and said electrophotographic photosensitive member, as a unit which can be removably mounted to the image forming system.

45. A method according to claim 36, wherein said process cartridge integrally incorporates therein at least a developing means as said process means, and said electrophotographic photosensitive member, as a unit which can be removably mounted to the image forming system.

46. A method according to claim 36, further comprising a resilient engagement piece formed at an opening portion of the process cartridge, wherein the connecting between said first member and second member is carried out by engaging said resilient engagement piece.

47. A method according to claim 36, wherein said process means comprises a developing sleeve and said developer container contains a developer to be used for developing an image by said developing sleeve.

48. A method according to claim 36, wherein said developer container contains a developer removed from said electrophotographic photosensitive member, and wherein said process means comprises a cleaning means.

49. A method according to claim 36, wherein said process means comprises a developing means.

50. A method according to claim 36, wherein said process means comprises a cleaning means.

51. A method according to claim 36, wherein said process means comprises a charging means.

52. A process cartridge removably mountable to an image forming system, said process cartridge comprising:

an electrophotographic photosensitive drum;

a charging member for charging said electrophoto-graphic photosensitive drum;

a developing sleeve for supplying a developer to said electrophotographic photosensitive drum for developing;

a cleaning blade for cleaning a residual developer from said electrophotographic photosensitive drum;

a first member, which forms a part of a developer container for containing a developer, said first member having an inclined connection surface;

a second member, which forms a part of said developer container for containing the developer, said second member having an inclined connection surface;

a seal member obtained by solidifying a liquid sealing material to produce an elastomer on said inclined connection surfaces at which said first member and said second member are joined to each other; and a delaying member, provided stepwisely on at least one of the inclined connection surface of said first member and the inclined connection surface of said second member, for delaying flow-down of the liquid sealing material on the at least one inclined connection surface.

53. A process cartridge according to claim 52, wherein said first member comprises an upper frame of said process cartridge and said upper frame includes said developer container for containing the developer to be used in a developing operation.

54. A process cartridge according to claim 52, wherein said second member comprises a lower frame of said process cartridge and said lower frame includes said electrophotographic photosensitive drum, said cleaning blade, and said developing sleeve disposed therein.

55. A process cartridge according to claim 52, wherein a pouring path for the liquid sealing material forms a closed loop.

56. A process cartridge according to claim 52, wherein said liquid sealing material is selected from the group consisting of: foam rubber, soft rubber, and soft plastics.

57. A process cartridge according to claim 52, wherein said developer container contains developer to be used in a developing operation.

58. A process cartridge according to claim 52, wherein said developer container contains developer removed from said electrophotographic photosensitive drum by said cleaning blade.

59. A process cartridge according to claim 52, wherein said process cartridge integrally incorporates therein said charging member, said developing sleeve, or said cleaning blade and said electrophotographic photosensitive drum, as a unit which can be removably mounted within the image forming system.

60. A process cartridge according to claim 52, wherein said process cartridge integrally incorporates therein at least one of said charging member, said developing member, said cleaning blade and said electrophotographic photosensitive drum, as a unit which can be removably mounted to the image forming system.

61. A process cartridge according to claim 52, wherein said process cartridge integrally incorporates therein at least said developing member, and said electrophotographic photosensitive drum, as a unit which can be removably mounted to the image forming system.

62. A process cartridge according to claim 52, further comprising a resilient engagement piece formed at an opening portion of the process cartridge, wherein the connecting between said first member and said second member is carried out by engaging said resilient engagement piece.

63. A process cartridge according to claim 52, wherein said developer container contains a developer to be used for developing an image by said developing sleeve.

64. A process cartridge according to claim 52, wherein said developer container contains a developer removed from said electrophotographic photosensitive drum.

* * * * *

UNITED STATES PATENT AND TRADEMARK OFFICE

CERTIFICATE OF CORRECTION

PATENT NO. : 5,561,504

DATED : October 1, 1996

INVENTOR(S) : KAZUSHI WATANABE, ET AL.

It is certified that error appears in the above-indentified patent and that said Letters Patent is hereby corrected as shown below:

SHEET 10 OF THE DRAWINGS:

Figure 23, "STIRREP" should read --STIRRER--.

COLUMN 2:

Line 53, "as" should read --as an--.

COLUMN 3:

Line 24, "sealing" should read --assembling--.

COLUMN 6:

Line 6, "contactness" should read --contact--.

COLUMN 8:

Line 45, "as" should read --as an--; and
Line 49, "contactness" should read --contact--.

UNITED STATES PATENT AND TRADEMARK OFFICE

CERTIFICATE OF CORRECTION

PATENT NO. : 5,561,504

DATED : October 1, 1996

INVENTOR(S) : KAZUSHI WATANABE, ET AL.

It is certified that error appears in the above-indentified patent and that said Letters Patent is hereby corrected as shown below:

COLUMN 9:

Line 50, "as" should read --as an--;
Line 60, "as" should read --as an--; and
Line 67, "member" should read --members--.

COLUMN 10:

Line 12, "means" should read --means,--.

COLUMN 11:

Line 55, "is" should read --are--;
Line 58, "100" should read --100 has--; and
Line 63, "unstream" should read --upstream--.

COLUMN 12:

Line 10, "light" should read --light is--; and
Line 52, "LBP" should read --(LBP)--.

COLUMN 14:

Line 66, "being" should read --is--.

UNITED STATES PATENT AND TRADEMARK OFFICE

CERTIFICATE OF CORRECTION

PATENT NO. : 5,561,504

DATED : October 1, 1996

INVENTOR(S) : KAZUSHI WATANABE, ET AL.

It is certified that error appears in the above-indentified patent and that said Letters Patent is hereby corrected as shown below:

COLUMN 17:

Line 6, "electrophoto-graphic" should read --electrophotographic--.

Signed and Sealed this

Twenty-ninth Day of April, 1997

Bruce Lehman

*Attest:*

BRUCE LEHMAN

*Attesting Officer*

*Commissioner of Patents and Trademarks*